United States Patent [19]

Frisbee et al.

[11] Patent Number: 4,782,607

[45] Date of Patent: Nov. 8, 1988

[54] REMOVABLE BUCKET TOOTH ASSEMBLY

[75] Inventors: Claude M. Frisbee, Bettendorf; Rudolf Horsch, Davenport; Victor R. Bowen, Bettendorf, all of Iowa

[73] Assignee: J. I. Case Company, Racine, Wis.

[21] Appl. No.: 885,295

[22] Filed: Jul. 14, 1986

[51] Int. Cl.[4] ..... E02F 9/28

[52] U.S. Cl. ..... 37/141 T; 403/408.1; 37/142 R

[58] Field of Search ..... 37/141 R, 141 T, 142 R, 37/142 A; 299/93; 403/408.1

[56] References Cited

U.S. PATENT DOCUMENTS

| | | | |
|---|---|---|---|
| 711,992 | 10/1902 | Mason, Jr. | 37/142 R |
| 1,553,096 | 9/1925 | Mullally | 37/142 R |
| 1,815,649 | 7/1931 | Edmunds | 37/142 R |
| 1,834,391 | 12/1931 | Edmunds | 37/142 R |
| 1,856,930 | 5/1932 | Robin | 37/142 R |
| 2,108,075 | 2/1938 | Mork | 37/142 R |
| 2,390,611 | 12/1945 | Nixon | 37/141 R |
| 4,120,105 | 10/1978 | Stepe | 37/142 R |
| 4,180,926 | 1/1980 | Klett et al. | 37/142 R |

FOREIGN PATENT DOCUMENTS

| | | | |
|---|---|---|---|
| 2458361 | 12/1974 | Fed. Rep. of Germany | 37/142 R |
| 2264140 | 11/1975 | France | 37/142 R |
| 941766 | 11/1963 | United Kingdom | 37/142 R |

*Primary Examiner*—E. N. Eickholt

*Attorney, Agent, or Firm*—Law Firm of Peter N. Jansson, Ltd.

[57] ABSTRACT

Improved means for removably attaching digging teeth to the cutting edge member of an earth-moving bucket. The attachment means includes a pair of clamping means which both apply sandwiching pressure on both the upper and lower surfaces of the edge member to hold the tooth in place against both front and side impacts.

16 Claims, 4 Drawing Sheets

37
18
28
40
36
74
76
90
26
86
82
84
68
83
78
87
80
70
12
72
14
20
34
30
16
42
36
40
76
20
28
83
86
88
84
82
87
70
20

REMOVABLE BUCKET TOOTH ASSEMBLY

FIELD OF THE INVENTION

This invention relates to removable bucket tooth assemblies for earth-moving equipment and, more particularly, to means for attachment of digging teeth to buckets.

BACKGROUND OF THE INVENTION

Scoops and buckets for excavating machines of various kinds are commonly provided with digging teeth for the purpose of loosening the earth or other material to be excavated. Such scoops or buckets typically have a pair of side walls and a bottom wall interconnecting the side walls. Such bucket bottom wall (or "cutting edge member") provides a forwardly disposed cutting edge along which a plurality of teeth are either permanently or removably mounted.

Having removable teeth is often highly desirable because it allows use of the bucket for certain jobs which require no teeth or in which teeth are in fact a detriment. But, because of certain problems with removable teeth, the advantages of removability in many cases are intentionally given up by simply welding the digging teeth permanently onto the cutting edge member of the bucket.

Removable teeth for certain types of earth-moving buckets of the prior art frequently tend to become loosened during their use. Such loosening occurs by virtue of repetitive front and side impacts on the teeth during digging operations. Side impacts and side loads on the teeth have a particularly severe effect in causing teeth to become loosened from their attachment to the cutting edge member.

Another problem encountered with removable digging tooth assemblies of the prior art is breakage. When teeth become partially loosened in their attachment to the cutting edge member, they often move around from one side to the other during digging operations. This can lead to breakage of the shank of the tooth or in some cases breakage of one of the mounting bolts.

A digging tooth of the type removably mounted on buckets typically has a forward pointed portion and a rearward shank portion. The shank portion typically has upper and lower prongs which form a slot to receive the cutting edge member of the bucket. The slot is wider than the thickness of the cutting edge member, so that such edge member may readily be received into the slot. Many removable digging teeth of the prior art are attached to the cutting edge member by a bolting-clamping action, which allows ready attachment and removal of teeth. Due at least in part to the fact that a gap remains in the slot after the cutting edge member is inserted therein, this form of removable attachment is often inconsistent and unsatisfactory and leads to the aforementioned tooth loosening and breakage problems.

Such bolting-clamping attachment means, while allowing easy detachment and reattachment, is often unsatisfactory. While the prongs of the tooth shank can usually be well clamped to the cutting edge member near the open end of the shank slot, such attachment at points nearer to the closed end of the slot is frequently inadequate.

More specifically, the attachment means of such prior art devices near the open end of the slot is relatively secure, providing clamping contact of both prongs of the tooth shank on the cutting edge member and double shear of the mounting bolt. However, the attachment means near the closed end of the slot provides little or no clamping contact of the prongs of the tooth shank on the cutting edge member, instead leaving gaps between the prongs and the cutting edge member. Thus, the tooth can pivot back and forth about the attachment means near the closed end of the slot. This makes the tooth less effective in digging action and can lead to shank and/or connecting bolt breakage.

A number of improvements have been made in means for attachment of digging teeth to the cutting edge member of earth-moving buckets. However, there remains a substantial need for improved means for removably attaching digging teeth to the cutting edge of earth-moving buckets. It is to such need that this invention is addressed.

SUMMARY OF THE INVENTION

This invention is an improved means for removably attaching digging teeth to the cutting edge member of an earth-moving bucket. This invention overcomes certain problems and disadvantages of the prior art, including those mentioned above.

In this invention, a digging tooth includes a shank portion with upper and lower prongs which form a slot into which the cutting edge member of a bucket is inserted. The slot is wider than the thickness of the cutting edge member and extends from an open end to a closed end. The invention involves the means by which such tooth is engaged with the cutting edge member.

The engagement means includes first and second clamping means which both apply sandwiching pressure on the upper and lower surfaces of the cutting edge member—at positions near the open end and near the closed end respectively. Both clamping means apply clamping contact onto both the upper and lower surfaces of the cutting edge member, either indirectly through the upper and lower prongs of the tooth shank or directly by the clamping means itself, to hold the tooth firmly in place against impacts from any direction.

The first clamping means, which is near the open end of the slot, is preferably a bolt means extending through both prongs of the tooth shank and the cutting edge member. It serves to bend the prongs of the shank into sandwiching contact with the upper and lower surfaces of the cutting edge member.

In certain preferred embodiments, the second clamping means, which may also be a bolt means, extends through the two prongs and the cutting edge member and has a pair of spaced end members (e.g., a bolt head and nut), means to draw the end members together (e.g., threading), and a spacer member extending from one of the end members directly to one of the surfaces of the cutting edge member. Such spacer member has a dimension sufficient to allow application of pressure therethrough onto such edge member surface.

As noted, the second clamping means is preferably a simple bolt and nut which may be drawn together in the normal fashion. The spacer member is preferably a bushing through which the bolt extends. The edge member surface preferably has a recess receiving one end of the spacer member to provide additional support against lateral pressure o the tooth.

In certain preferred embodiments, the two prongs and the cutting edge member have holes dimensioned and located such that the edge of the cutting edge member is positioned short of contact with the closed end of the slot. This positioning is helpful since it is unreasonable in this sort of equipment, which undergoes much wear and in which wide interchangeability is required, to locate the holes with enough precision to be sure that the cutting edge always bears firmly against the slot end.

When the first and second clamping means are tightened, each applies pressure to both the upper and lower surfaces of the cutting edge member. This full clamping action by each of two clamping means on the tooth serves to hold the tooth firmly in place. Yet the tooth may be removed and replaced easily.

The spacer member is preferably in direct contact with the lower surface of the cutting edge member. However, a reverse configuration could be used instead.

In another preferred embodiment of this invention, the upper and lower prongs of the tooth shank include elongated openings which are elongated in a direction along the prongs. There is a pair of such elongated openings (or holes) for each of the first and second clamping means, and such elongated openings allow adjustable positioning of the tooth and cutting edge member such that the cutting edge may be positioned in firm contact with the closed end of the slot.

The second clamping means, preferably a bolt means with certain mounted members, has a pair of spaced end structures and means to draw the end structures together. The end structures may be a bolt head and nut or a bolt head or nut in combination with a spacer, such as a bushing, and bolt threading provides the drawing means. One elongated opening, the one through which the second clamping means extends, is dimensioned to non-rotatably receive one of the end structures (e.g., a bolt head, nut or bushing) at adjustable positions along such elongated opening.

Such end structure in such elongated opening bears on one of the surfaces of the cutting edge member, preferably the lower surface, and when the second clamping means is drawn together, such as by bolt tightening, such end structure pulls the cutting edge member firmly against one of the prongs of the tooth shank. This action firmly holds the tooth in place, overcoming the problems associated with the aforementioned gap between the slot and the cutting edge member near the closed end of the slot.

As suggested, the end structure which is non-rotatably located within an elongated opening may be a bolt head or nut in direct contact with one surface of the cutting edge member. Or, it may include an end member (i.e., a bolt head or nut) and a spacer member extending from the end member to the surface of the cutting edge member. Such spacer member preferably has an axial dimension sufficient to allow application of pressure through it onto such end member surface.

When a spacer member is used in such embodiments, it is preferably a bushing through which a bolt extends. Such bushing has flat sides such that it non-rotatably engages the elongated opening in which it is located. The cutting edge member surface which such bushing contacts may have a recess to receive one end of such bushing to provide more support, as previously described.

Many different variations of the invention are possible. In each, however, clamping force is applied directly and forcefully to both sides of the cutting edge member by two clamping means, one of which is near the closed end of the slot formed in the tooth shank.

OBJECTS OF THE INVENTION

It is an object of this invention to provide an improved bucket edge of the type having removable teeth along a cutting edge member which overcomes certain problems and disadvantages of prior art devices.

Another object of this invention is to provide an improved means for removable attachment of a digging tooth to a bucket which holds the tooth more firmly in place during extended digging operations.

Another object of this invention is to provide an improved bucket tooth attachment means which reduces the incidence of loosening of digging teeth.

Another object of this invention is to provide an improved bucket tooth attachment means which reduces shank breakage and the breakage of connecting bolts.

Another object of this invention is to provide an improved bucket tooth attachment means which gives reliable firm attachment of the tooth to the bucket while still allowing easy removal and reattachment.

These and other important objects will be apparent from the following descriptions and from the drawings, wherein:

DETAILED DESCRIPTION OF PREFERRED EMBODIMENTS

Figure 1:
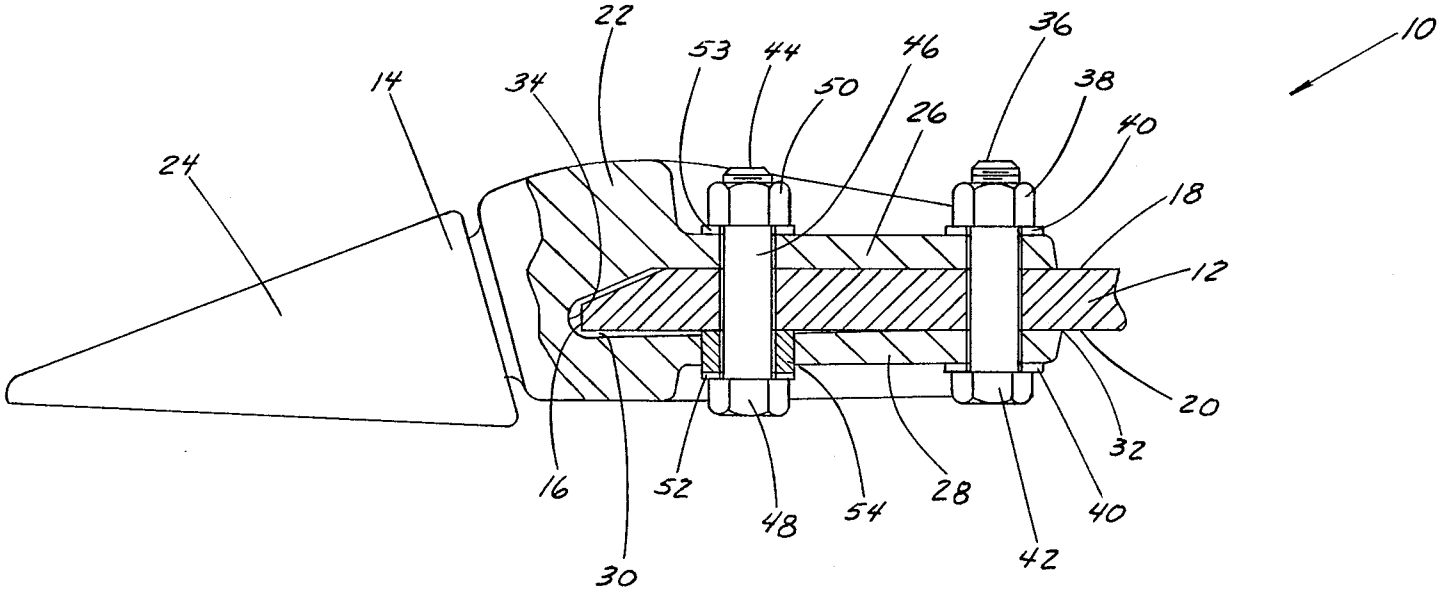
FIG. 1 is a partially sectional fragmentary side elevation of a preferred embodiment of the invention.

The drawings show four different embodiments of the invention. The embodiments differ only in the specific means by which teeth are attached to the cutting edge of an earth-moving bucket. Throughout the drawings, the same numbers are used to identify like parts.

FIGS. 1, 2, 3 and 5 illustrate a portion of a toothed bucket edge 10. Bucket edge 10 includes a cutting edge member 12 which forms the bottom plate of a bucket for earth-moving equipment, a tooth 14 which is one of several identical teeth along cutting edge member 12, and first and second clamping means for removably attaching tooth 14 to cutting edge member 12.

Cutting edge member 12 includes an upper surface 18, a lower surface 20, and a cutting edge 16. Most of cutting edge member 12 is exposed between adjacent pairs of teeth 14 for cutting and digging actions, but portions of cutting edge member 12 are engaged with teeth 14.

Each tooth 14 includes a shank portion 22 and a pointed digging portion 24. Pointed digging portion 24 may be integrally formed with shank portion 22 or may be removably attachable with shank portion 22. The manner in which shank portion 22 and pointed digging portion 24 forms no part of this invention.

Shank portion 22 of tooth 14 has an upper prong 26 and a lower prong 28 which together form a slot 30. Slot 30 is formed to be wider t all portions along its length than the thickness of cutting edge member 12, such that cutting edge member 12 may readily be received within slot 30. That is, prior to application of the first and second clamping means, by which cutting edge member 12 is secured within slot 30, a gap exists within slot 30 between cutting edge member 12 and prongs 26 and 28.

Slot 30 extends from an open end 32 to a closed end 34. In the embodiments shown in FIGS. 1 and 2, cutting edge 16 is spaced short of contact with closed end 34; in the embodiments shown in FIGS. 3 and 5, cutting edge 16 is in contact with closed end 34.

Each of the illustrated embodiments includes a first clamping means near the slot open end 32. Such first clamping means includes a bolt 36 having a shank 37, with a nut 38 and washers 40 thereon, which applies sandwiching pressure on upper and lower surfaces 18 and 20 through upper and lower prongs 26 and 28 of tooth shank portion 22. Head 42 of bolt 36 and nut 38 are drawn together by the normal bolt-tightening action, and this action bends upper and lower prongs 26 and 28 toward each other into sandwiching contact with upper and lower surfaces 18 and 20, respectively.

Such bending and the resultant contact eliminates the gap which would otherwise exist between prongs 26 and 28 and upper surface 18 and/or lower surface 20. Such bending is possible because of the length of prongs 26 and 28 and the remoteness of bolt 36 from closed end 34 of slot 30. In this manner, good sandwiching contact can occur near slot open end 32.

However, direct sandwiching contact of prongs 26 and 28 with both upper and lower surfaces 18 and 20 of cutting edge member 12 is not possible near slot closed end 34, since the prongs cannot readily be bent sufficiently at that point. Each of the illustrated embodiments of this invention includes a second clamping means which applies sandwiching pressure on upper and lower surfaces 18 and 20 of cutting edge member 12 at a position near closed end 34.

The second clamping means of the various embodiments shown in the drawings apply sandwiching pressure in various ways. In each embodiment, however, the clamping means near closed end 34 is such that clamping pressure is applied directly or indirectly onto upper and lower surfaces 18 and 20 of cutting edge 16. This overcomes the problem of the aforementioned gap which exists near slot closed end 34. Firm engagement continues despite both front and side impacts on tooth 14, while still allowing tooth 14 to be easily removable and reattachable.

Figure 2:
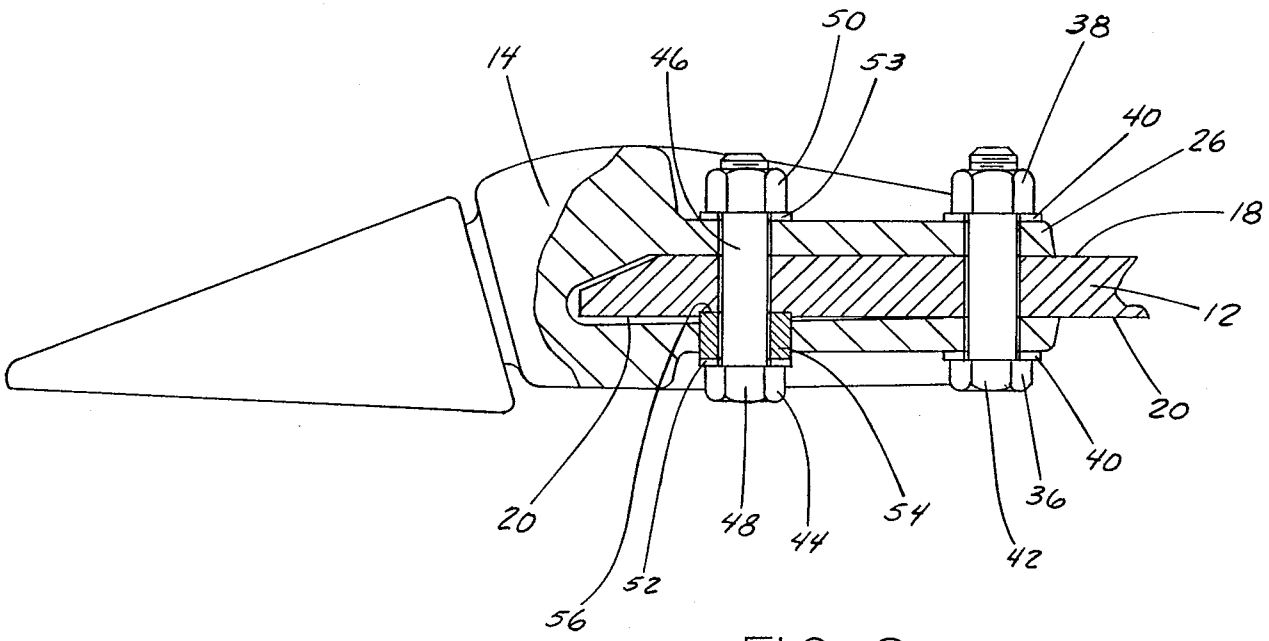
FIG. 2 is a similar view of another preferred embodiment.

In the embodiments of FIGS. 1 and 2, the second clamping means includes a bolt 44, the shank 46 of which extends through holes in lower prong 28, cutting edge member 12, and upper prong 26. The head 48 of bolt 44 and a nut 50 engaged with bolt 44 are drawn together in the normal manner against lower and upper washers 52 and 53, respectively. A spacer bushing 54 extends from lower washer 52 to lower surface 20, and applies the drawing pressure of bolt 44 directly onto cutting edge member 12.

Spacer bushing 54 has an axial dimension along bolt 44 which is sufficient to allow application of pressure through it by bolt head 48 onto lower surface 20 of cutting edge member 12. Indeed, the axial dimension of spacer bushing 54 exceeds the thickness of lower prong 28 by an amount greater than the aforementioned gap which is in slot 30 prior to the tightening of bolts 36 and 44. This allows the application of pressure through spacer bushing 54 onto lower surface 18.

The holes in upper and lower prongs 26 and 28 and cutting edge member 12, made to snugly receive bolt 44 and (in the case of lower prong 26) spacer bushing 54, are dimensioned and located such that cutting edge 16 is positioned short of contact with closed end 34. Given the wear which occurs on cutting edge 16 and the normal tolerances for parts of this type, it would not be readily possible to provide cutting edge to slot end contact.

The embodiment shown in FIG. 2 differs from that shown in FIG. 1 only in that lower surface 20 has a recess 56 in it which is shaped and dimensioned to receive one end of spacer bushing 54. This recessed configuration provides additional support for tooth 14.

The embodiments illustrated in FIGS. 3–4 and 5–6 are somewhat different than those shown in FIGS. 1 and 2. The differences are in the form of the second clamping means, that is, the clamping means which applies pressure on upper and lower surfaces 18 and 20 of cutting edge member 12 at a position near closed end 34.

Figure 3:
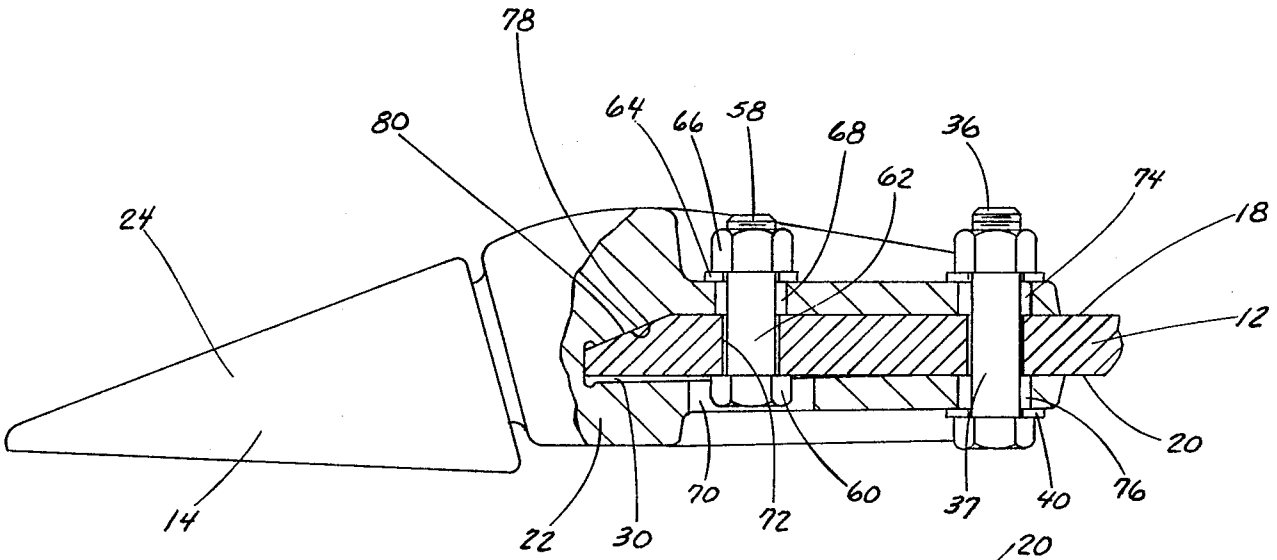
FIG. 3 is a similar view of yet another preferred embodiment.
Figure 4:
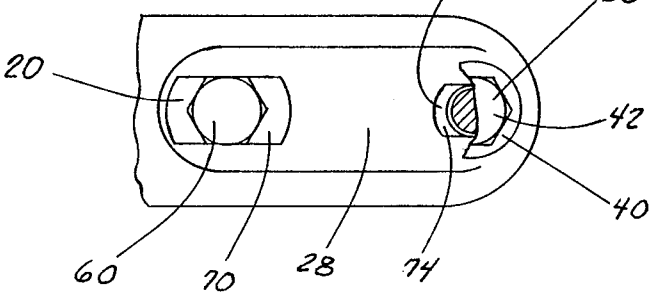
FIG. 4 is a partially cutaway fragmentary bottom plan view of FIG. 3.

Referring to the embodiment of FIGS. 3 and 4, the first clamping means is generally similar to the first clamping means of the embodiments of FIGS. 1 and 2, having bolt 36, bolt head 42, nut 36 and washers 40. The hole in cutting edge member 12 through which shank 37 of bolt 36 extends is round and receives shank 37 snugly. Unlike the embodiments of FIGS. 1 and 2, however, the holes in upper and lower prongs 26 and 28 are elongated holes 74 and 76, respectively, which are elongated in a direction along the length of the prongs to allow a degree of adjustable movement of shank 37 of bolt 36 along the prongs. The term "elongated" indicates that, regardless of the width of holes 74 and 76, they have room for movement of shank 37 therein in a direction along the prongs.

The second clamping means can also undergo adjustable movement along the prongs in the same way. Such clamping means includes a bolt 58 with a head 60 and a shank 62 on which a washer 64 and nut 66 are attached. Upper and lower prongs 26 and 28 have elongated openings 68 and 70, respectively, extending therethrough. Like openings 74 and 76, openings 68 and 70 are elongated in a direction along the prongs. Shank 62 of bolt 58 extends snugly through a round opening 72 in cutting edge member 12.

Elongated opening 70 is just wide enough in one crossdimension to receive head 60 of bolt 58 in nonrotatable fashion. Elongated openings 68 and 70 are positioned and dimensioned such that, prior to tightening of bolts 58 and 36, cutting edge member 12 may be varied slightly in its extent of insertion into slot 30 and, indeed, may be positioned such that cutting edge 16 is in contact with closed end 34 of slot 30.

In the embodiment of FIGS. 3 and 4, bolt head 60 is in direct contact with lower surface 20 of cutting edge member 12. As nut 66 is tightened, bolt head 60 draws cutting edge member 12 firmly against upper prong 26, including beveled portion 78 which is engaged firmly by beveled portion 80 of upper surface 18.

Figures 5, 6:
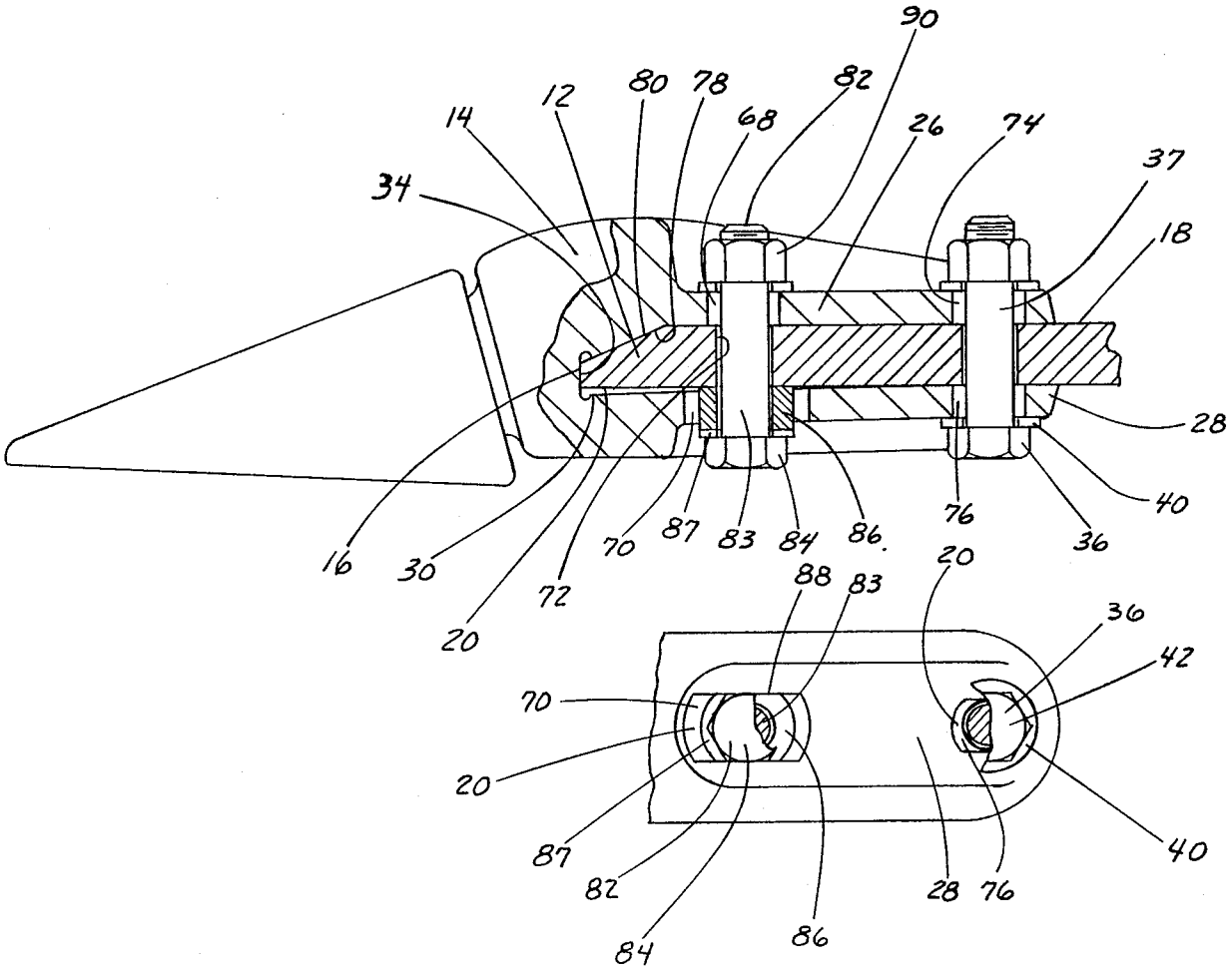
FIG. 5 is a partially sectional fragmentary side elevation of still another preferred embodiment.
FIG. 6 is a partially cutaway fragmentary bottom plan view of FIG. 5.

In the assembly of FIGS. 5 and 6, bolt 82 has a shank 83 which extends through upper and lower prongs 26 and 28 and edge member 12, and a head 84, a spacer bushing 86 and a washer 87 which form an end structure. Such end structure is drawn against lower surface 20 of edge member 12 in the same manner as bolt head 60 is drawn in the embodiment of FIGS. 3 and 4. Spacer bushing 86 has an axial dimension sufficient to allow application of pressure through it onto lower surface 20. More specifically, spacer bushing 86 has an axial dimension which exceeds the thickness of lower prong 28 by an amount greater than the gap existing within slot 30 prior to the tightening of bolts 36 and 82.

The embodiment of FIGS. 5 and 6 has elongated openings 68 and 74 in upper prong 26 and elongated openings 70 and 76 in lower prong 26 which are similar to the elongated openings in the embodiment of FIGS. 3 and 4. Elongated openings 68, 70, 74 and 76 allow cutting edge member 12 to be adjustably inserted within slot 30 such that cutting edge 16 may be brought into full engagement with closed end 34 and beveled portion 80 of upper surface 18 of cutting edge member 12 may be brought into full engagement with beveled portion 78 of upper prong 26.

Spacer bushing 86 has flat sides 88 which allow it to be non-rotatably engaged within elongated opening 70. By the tightening of nut 90 with bolt 82, spacer bushing 86 is brought into sandwiching contact with lower surface 20 of cutting edge member 12. This action, together with the sandwiching action of bolt 36 near open end 32 of slot 30, provides a firm engagement of tooth 14 with cutting edge member 12.

In each of the illustrated embodiments, upper surface 18 of cutting edge member 12 has been brought into tight engagement with upper prong 26, with any remaining gap being left between lower surface 20 of cutting edge member 12 and lower prong 28. Orienting the second clamping means to apply sandwiching pressure on upper and lower surfaces 18 and 20 in this particular manner is preferred. However, the reverse orientation could be used.

The improved means of this invention for removable attachment of tooth 14 to cutting edge member 12 not only provides firm double sandwiching engagement of cutting edge member 12 to hold tooth 14 in place against both front and side impacts, but it provides this firm attachment in an easily removable form. Teeth like tooth 14 can readily be removed when a toothless cutting edge is desired, and then replaced as needed without difficulty.

The elements of this invention may be made of high-strength materials which are well known to those skilled in the art. The teeth may be steel castings, forgings, or otherwise. The cutting edge member is a fabricated steel plate. The bolts, spacer bushings and other attachment devices are all well known and readily available.

While the principles of this invention have been described in connection with specific embodiments, it should be understood clearly that these descriptions are made only by way of example and are not intended to limit the scope of the invention.

What is claimed:

1. In means for removably attaching to the cutting edge member of an earth-moving bucket a tooth of the type having a shank portion with substantially parallel upper and lower prong surfaces forming a slot which is wider than the distance between substantially parallel upper and lower surfaces of the edge member and extends from an open end to a closed end, with the cutting edge member received within the slot, the improvement comprising:

first clamping means applying sandwiching pressure on the upper and lower surfaces of the edge member at a position near the open end; and second clamping means applying sandwiching pressure on the upper and lower surfaces of the edge member at a position near the closed end, the second clamping means being in direct contact with one of said upper and lower cutting edge member surfaces, whereby the tooth is both firmly held in place against both front and side impacts and readily removable and reattachable.

2. In a bucket edge for earth-moving equipment of the type having a cutting edge member with substantially parallel upper and lower surfaces and a given thickness, at least one tooth along the edge member, and means removably securing the tooth to the edge member, the improvement in the securing means comprising:

such tooth including a shank portion with upper and lower prongs, the upper and lower prongs having substantially parallel upper and lower prong surfaces, respectively, forming a slot which is wider than the given thickness and extends from an open end to a closed end, the cutting edge member being received within the slot;

first clamping means applying sandwiching pressure on the upper and lower surfaces of the edge member at a position near the open end; and second clamping means applying sandwiching pressure on the upper and lower surfaces of the edge member at a position near the closed end, the second clamping means including bolt means extending through the two springs and the cutting edge member and having a pair of spaced end members and means to draw them together, a bushing around the bolt means extending from one of the end members to one of the edge member surfaces, said bushing having a dimension sufficient to allow application of pressure therethrough onto said one edge member surface, whereby the tooth is both firmly held in place against both front and side impacts and readily removable and reattachable.

3. The device of claim 2 wherein the two prongs and the cutting edge member have holes receiving the bolt means and bushing member which are dimensioned and located such that the cutting edge is positioned short of contact with the closed end of the slot.

4. The device of claim 2 wherein said one edge member surface has a recess and the bushing is in the recess thereby to provide additional support.

5. The device of claim 2 wherein said one edge member surface is the lower surface.

6. In a bucket edge for earth-moving equipment of the type having a cutting edge member with upper and lower surfaces and a given thickness, at least one tooth along the edge member, and means removably securing the tooth to the edge member, the improvement in the securing means comprising:

such tooth having a shank portion with upper and lower prongs forming a slot which is wider than the given thickness and extends from an open end to a closed end, the cutting edge member being received within the slot;

first clamping means applying sandwiching pressure on the upper and lower surfaces of the edge member at a position near the open end;

second clamping means applying sandwiching pressure on the upper and lower surfaces of the edge member at a position near the closed end, the second clamping means being in direct contact with one of said upper and lower cutting edge member surfaces; and the second clamping means extending through one of the two prongs, the cutting edge member, and at least a portion of the other of the two prongs and including:

a pair of spaced end structures and means to draw the end structures together;

the prongs including openings extending therethrough which are elongated in a direction along the prongs, one of the elongated openings being dimensioned to receive one of the end structures non-rotatably at adjustable positions along the elongated opening;

said one end structure being inserted in said one elongated opening and bearing on one of the surfaces of the cutting edge member; and the elongated openings being located such that the cutting edge may be positioned in contact with the closed end of the slot, whereby the tooth is both firmly held in place against both front and side impacts and readily removable and reattachable.

7. The device of claim 6 wherein the end structures and the drawing means are bolt means.

8. The device of claim 6 wherein said one end structure comprises an end member and a spacer member extending from the end member to said one edge member surface, said spacer member having a dimension sufficient to allow application of pressure therethrough onto said one edge member surface.

9. The device of claim 8 wherein said one edge member surface has a recess and the spacer member is in the recess thereby to provide additional support.

10. The device of claim 8 wherein the end member, the other end structure, and the drawing means are bolt means and the spacer member is a bushing through which the bolt extends, the bushing having flat sides such that it non-rotatably engages said one elongated opening.

11. The device of claim 8 wherein said one edge member surface has a recess and the bushing is in the recess thereby to provide additional support.

12. The device of claim 6 wherein the upper and lower prongs have holes which are elongated in a direction along the prongs, and wherein the first clamping means comprises bolt means extending through the elongated holes and bending the upper and lower prongs into sandwiching contact with the upper and lower surfaces.

13. The device of claim 6 said one edge member surface is the lower surface.

14. In a bucket edge for earth-moving equipment of the type having a cutting edge member with substantially parallel upper and lower surfaces and a given thickness, at least one tooth along the edge member, and means removably securing the tooth to the edge member, the improvement in the securing means comprising:

such tooth including a shank portion with upper and lower prongs, the upper and lower prongs having substantially parallel upper and lower prong surfaces, respectively, forming a slot which is wider than the given thickness and extends from an open end to a closed end, the cutting edge member being received within the slot;

first clamping means applying sandwiching pressure on the upper and lower surfaces of the edge member at a position near the open end;

second clamping means applying sandwiching pressure on the upper and lower surfaces of the edge member at a position near the closed end, the second clamping means being in direct contact with one of said upper and lower cutting edge member surfaces; and said second clamping means extending through the two prongs and the cutting edge member and having a pair of spaced end members, means to draw the end members together, and a spacer member extending from one of the end members to one of the edge member surfaces, said spacer member having a dimension sufficient to allow application of pressure therethrough onto said one edge member surface, whereby the tooth is both firmly held in place against both front and side impacts and readily removable and reattachable.

15. The device of claim 14 wherein said one edge member surface has a recess and the spacer member is in the recess thereby to provide additional support.

16. The device of claim 14 wherein the first clamping means comprises bolt means bending the upper and lower prongs into sandwiching contact with the upper and lower surfaces.

* * * * *

UNITED STATES PATENT AND TRADEMARK OFFICE

CERTIFICATE OF CORRECTION

PATENT NO. : 4,782,607

DATED : November 8, 1988

INVENTOR(S) : Claude Frisbee, Rudolf Horsch and Victor Bowen

It is certified that error appears in the above-identified patent and that said Letters Patent is hereby corrected as shown below:

In column 2, line 65, after "pressure", delete "o" and insert --on--.

In column 5, line 3, after "wider", delete "t" and insert --at--.

In claim 3, line 3, delete "member".

Signed and Sealed this

Seventh Day of March, 1989

*Attest:*

*Attesting Officer*

DONALD J. QUIGG

*Commissioner of Patents and Trademarks*